US005174371A

United States Patent [19]

Grillo

[11] Patent Number: 5,174,371

[45] Date of Patent: Dec. 29, 1992

[54] ATMOSPHERIC VAPORIZER HEAT EXCHANGER

[75] Inventor: Frank J. Grillo, Riverside, Calif.

[73] Assignee: Cryoquip, Inc., Murrieta, Calif.

[21] Appl. No.: 825,943

[22] Filed: Jan. 27, 1992

[51] Int. Cl.[5] ..... F28F 1/16

[52] U.S. Cl. ..... 165/171; 165/78; 165/183

[58] Field of Search ..... 165/183, 78, 171

[56] References Cited

U.S. PATENT DOCUMENTS

| | | | |
|---|---|---|---|
| 2,162,083 | 6/1939 | Higham et al. | 165/171 |
| 3,301,319 | 1/1967 | Merrill | 165/171 |
| 3,672,446 | 6/1972 | Tibbetts et al. | 165/183 |
| 4,114,598 | 9/1978 | Van Leeuwen | 165/171 |
| 4,131,110 | 12/1978 | Jones, Jr. | 165/171 |
| 4,479,359 | 10/1984 | Pelloux-Gervais | 165/183 |
| 4,487,256 | 12/1984 | Lutjens et al. | 165/183 |
| 4,679,617 | 7/1987 | Keldmann | 165/171 |
| 4,759,402 | 7/1988 | Osojnak | 165/171 |

FOREIGN PATENT DOCUMENTS

| | | | |
|---|---|---|---|
| 496027 | 9/1953 | Canada | 165/171 |
| 1012898 | 12/1965 | United Kingdom | 165/171 |
| 2146422 | 4/1985 | United Kingdom | 165/78 |

*Primary Examiner*—John Rivell
*Assistant Examiner*—L. R. Leo
*Attorney, Agent, or Firm*—Harold L. Jackson

[57] ABSTRACT

An improved atmospheric vaporizer/heat exchanger adapted for vaporizing cryogenic liquids includes a heat exchange element having a tube through which the cryogenic fluid flows and a plurality of fins attached to the tube. At least some of the fins include on their edges a rail or like member which has substantially flat surfaces. Brackets interconnect the fins of the heat exchange elements through channel shaped members disposed on two parallel edges. The channel shaped members of the brackets are configured to be complementary to the rails and have complementary substantially flat surface which mate with the matching flat surfaces of the rails and thereby substantially prevent rotation of the heat exchange elements relative to the brackets. After assembly, the matching rails and channels are deformed in sections by crimping or the like, to prevent sliding of the brackets on the rails and to obtain a finally assembled structure.

24 Claims, 3 Drawing Sheets

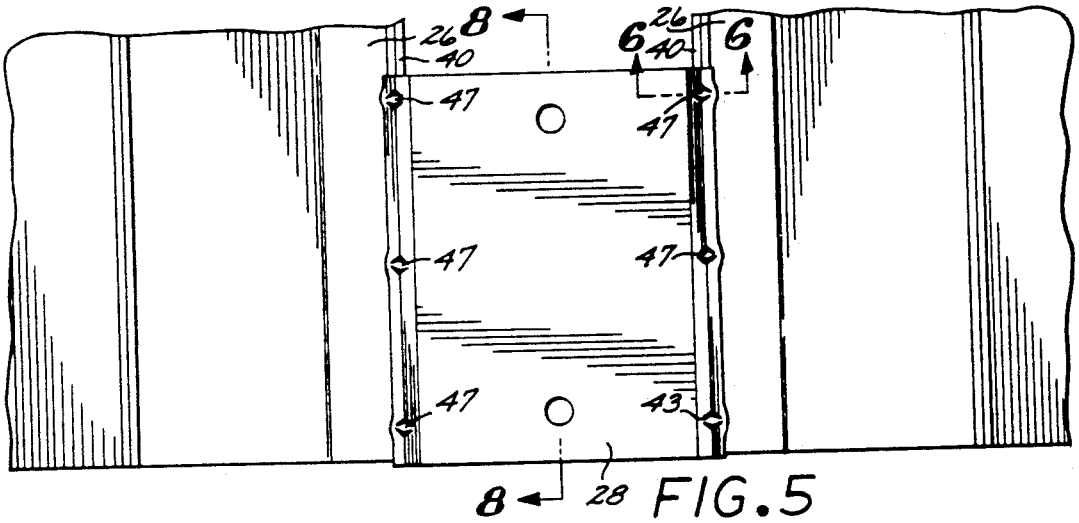
FIG. 5
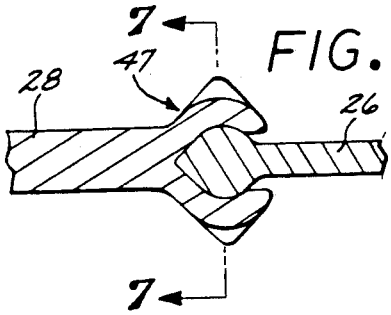
FIG. 6
FIG. 7
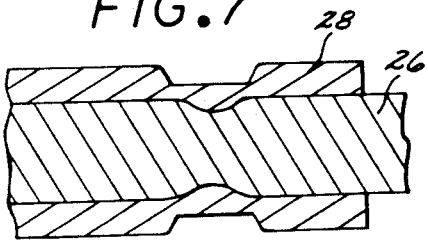
FIG. 8
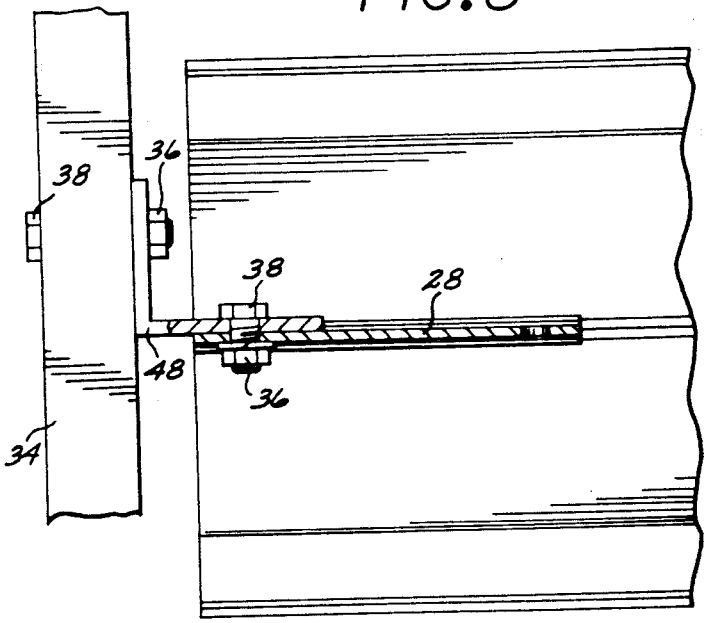
FIG. 9
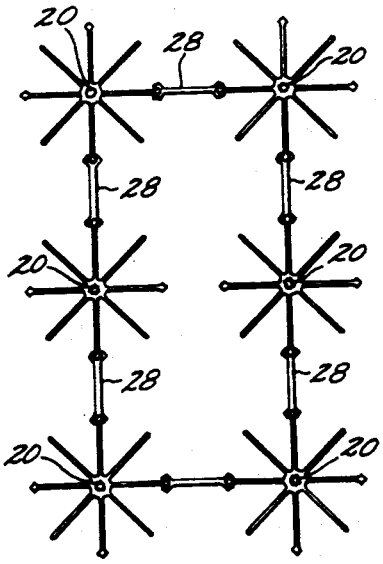

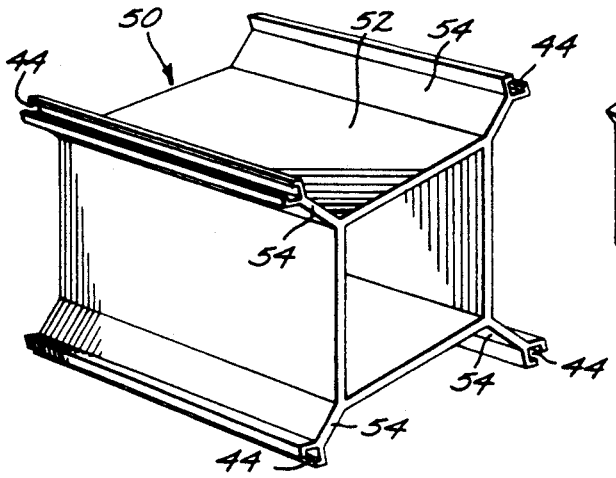
FIG. 10
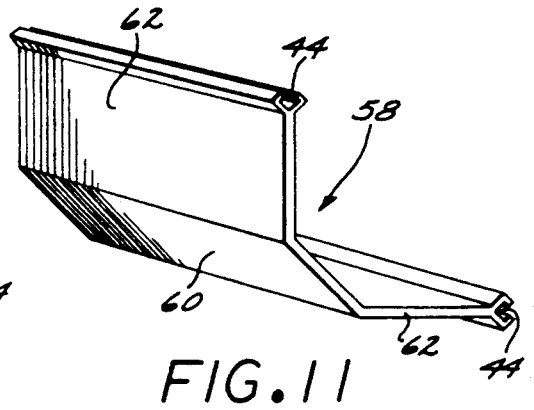
FIG. 11
FIG. 12
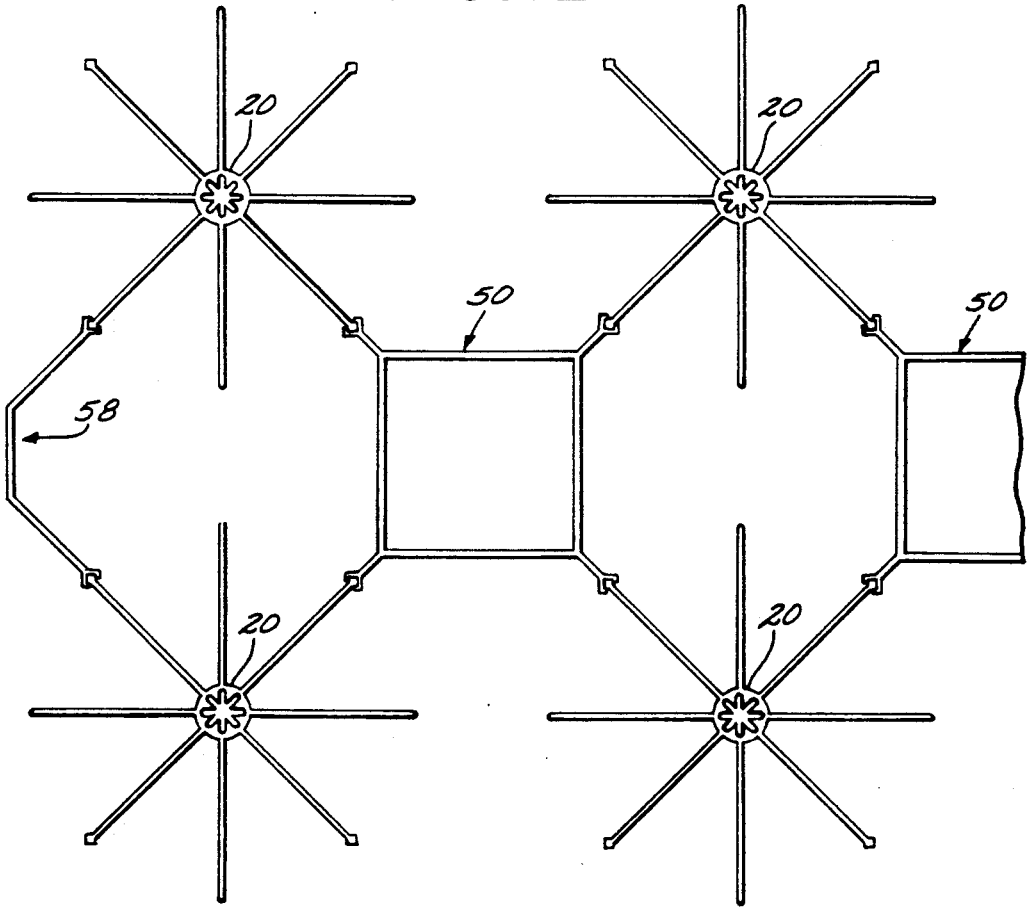

ATMOSPHERIC VAPORIZER HEAT EXCHANGER

BACKGROUND OF THE INVENTION

1. Field of the Invention

The present invention is directed to an atmospheric vaporizer and heat exchanger primarily adapted for vaporizing cryogenic liquids. More particularly, the present invention is directed to an atmospheric vaporizer/heat exchanger which is an assembly of a plurality of finned heat exchange tubes and brackets fixedly attached to one another without the use of self-tapping screws.

2. Brief Description of the Prior Art

Atmospheric vaporizers have been known in the art for a long time. These devices are used in industry to vaporize relatively large quantities of a cryogenic liquid which is needed in the gaseous form for certain manufacturing operations. In essence, an atmospheric vaporizer is a heat exchanger which utilizes ambient heat to vaporize the very low boiling (cryogenic) liquid. A typical example for the use of atmospheric vaporizers/-heat exchangers is the vaporization of liquid oxygen for use in various industrial processes and welding operations.

State of the art atmospheric vaporizers/heat exchangers include a plurality of heat exchange elements which are finned tubes made of good heat conducting materials (usually aluminum). The finned tubes are mechanically assembled to one another and to a substantially rigid frame. Flow of the cryogenic fluid through the tubes may be in a parallel (for certain applications) or series fashion, or a combination of the two, to maintain the height of the exchanger within reasonable limits. The relatively large surface of the fins facilitates efficient heat exchange with the environment; in other words, the fins promote relatively efficient absorption of heat from the ambient atmosphere and thus provide the heat required for vaporization of the cryogenic liquid. An atmospheric vaporizer/heat exchanger, including specific dimensions for the fins of its elongated finned tube, is described in U.S. Pat. No. 4,479,359. Further information relating to heat exchangers, and various ways of attaching panels and other items to one another, can be found in the following references: Austrian Patent No. 222310; French Patents Nos. 1,127,107; 1,217,649; 1,027,613; and U.S. Pat. Nos. 4,774,792; 2,307,216; 3,032,603; 3,512,805, and 4,777,777.

State of the art atmospheric vaporizers/heat exchangers typically utilize brackets or plates to interconnect the fins of the finned tubes in order to provide mechanical integrity to the assembled heat exchange tubes. In a typical state-of-the-art assembly, the brackets or plates are attached to the fins with self-tapping screws or by a welding operation. The brackets then are attached to a rigid frame by bolts and nuts positioned through preformed holes in the brackets.

There are significant disadvantages of the above-summarized state-of-the-art assembly. Spacers are required for the assembly of the brackets and finned tubes (or heat exchange elements) while the brackets are fastened to the fins with the self-tapping screws or by welding. Welding is a very labor intensive and therefore a costly operation. Furthermore, the quality of the welds often creates an aesthetic problem. The use of screws to fasten the brackets to the fins is also time consuming. Also, the screws which protrude with their sharp points on one side of the assembled brackets or fins represent a safety hazard. Although the screws used in this operation are typically cadmium plated, the plating is often damaged especially where the screws contact the aluminum fins and brackets, and therefore corrosion is a frequent problem.

The present invention is designed to eliminate or minimize the above-noted problems which have arisen in the prior art with the assembly of the finned heat exchange elements and brackets with screws.

SUMMARY OF THE INVENTION

In accordance with my invention the above noted problems are eliminated or minimized by an assembly of heat exchanger elements and brackets, adapted for vaporizing a cryogenic fluid, where the heat exchanger element includes an elongated tube which forms an internal conduit for the flow of the cryogenic fluid. A plurality of fins are disposed radially outwardly from the tube, and at least two of the fins have on their edges means for slidably engaging complementary means disposed on the edge of the brackets. The means on the edges of the fins and on the brackets are configured to be capable of slidably engaging one another and to prevent relative rotation between the assembled fin and bracket. One or more portion of the assembled fins and brackets are deliberately deformed after assembly, for example by crimping, so as to prevent sliding and to immovably affix the finned heat exchange elements to the brackets.

The features of the present invention can be best understood, together with further objects and advantages by reference to the following description, taken in connection with the accompanying drawings, wherein like numerals indicate like parts.

BRIEF DESCRIPTION OF THE DRAWINGS

FIG. 5 is a partial side view showing the interconnection and fastening of two heat exchange elements with the first preferred embodiment of the bracket;

FIG. 6 is a partial cross-sectional view taken on lines 6,6 of FIG. 5;

FIG. 7 is a partial cross-sectional view taken on lines 7,7 of FIG. 6;

FIG. 8 is a cross-sectional view analogous to a view taken on lines 8,8 of FIG. 5, but also showing the heat exchanger element and bracket assembly mounted to a frame;

FIG. 9 is a schematic top view of the assembly of several heat exchange elements and brackets to one another, in accordance with the present invention;

FIG. 10 is a perspective view of a second preferred embodiment of the bracket of the present invention;

FIG. 11 is a perspective view of a third preferred embodiment of the bracket of the present invention; and FIG. 12 is a schematic top view of the assembly of several heat exchange elements and several preferred embodiments of the brackets to one another, in accordance with the present invention.

DESCRIPTION OF THE PREFERRED EMBODIMENT

Figure 1:
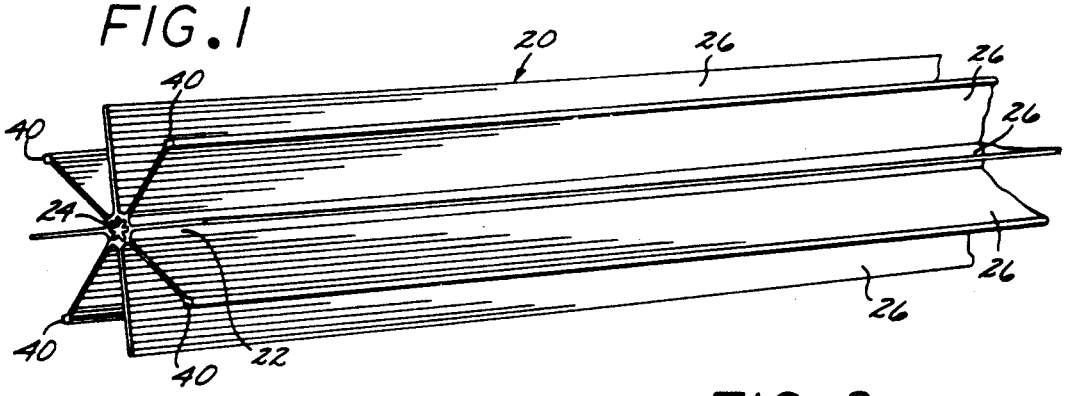
FIG. 1 is a perspective view of the heat exchange element and bracket combination of the present invention showing a first preferred embodiment of the bracket.
Figure 2:
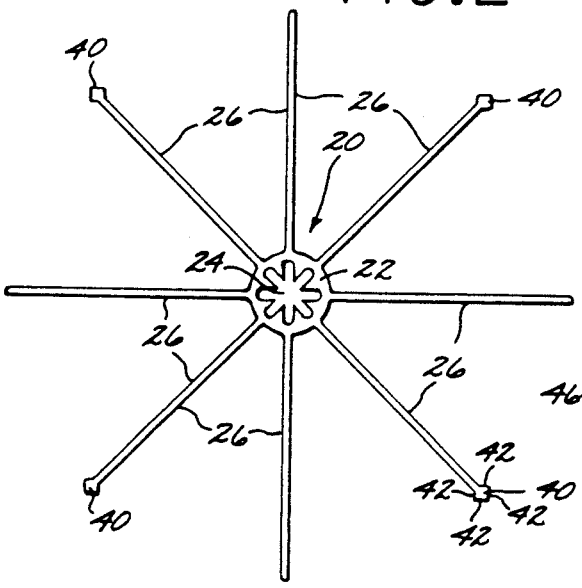
FIG. 2 is a front view of the heat exchange element shown in FIG. 1.

Referring now to the drawings and particularly to FIG. 1, a preferred embodiment of the heat exchange element or heat exchange tube 20 includes a substantially cylindrical tube 22 which forms an internal conduit 24 through which the cryogenic fluid (not shown) flows when the invention is utilized for its intended purpose, that is, as an atmospheric vaporizer/heat exchanger to convert relatively large quantities of a cryogenic liquid (such as liquid oxygen or nitrogen) to gas. As is shown in the drawing figures, the internal conduit 24 is not circular, (that is it does not form a simple annulus) but rather is star shaped so as to increase its internal surface area and thereby improve the overall heat exchange capability of the heat exchange element 20. A plurality of fins 26 are attached to the elongated cylindrical tube 22, and the fins 26 are disposed outwardly in a radial direction. In the herein described preferred embodiment the heat exchange element 20 has eight fins 26 which are substantially symmetrically placed (at approximately 45°) relative to one another. Each fin 26 is a substantially flat panel. The function of the fins 26 is to provide a large surface area through which heat exchange with the ambient air can take place. The diameter of the internal conduit 24 may be of the order of about ½ to 2 inches, the outer diameter of the cylindrical tube 22 may be of the order of about 1 to 2 ½ inches, the width of the fins 26 may be of the order of about 3 to 6 inches, and the thickness of the plate which forms the fins 26 may be of the order of about 1/16 to 3/16 of an inch. The heat exchange element 20 may be up to 25 feet long. As it will be readily understood by those skilled in the art, the above noted dimensions are exemplary for the herein described preferred embodiment 20 and can be varied extensively without departing from the scope of the invention.

Figure 3:
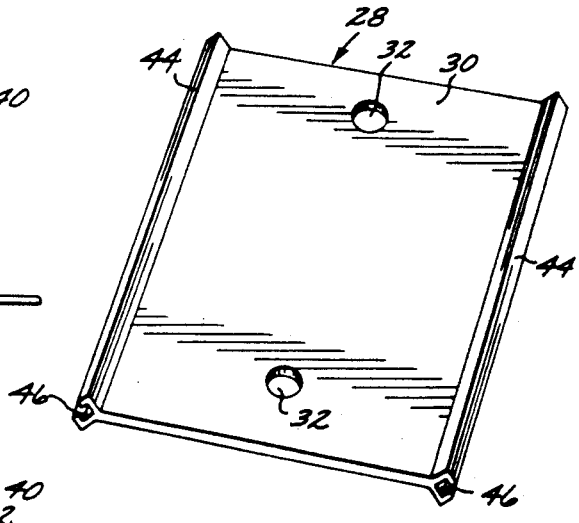
FIG. 3 is a perspective view of the first preferred embodiment of the bracket.
Figure 4:
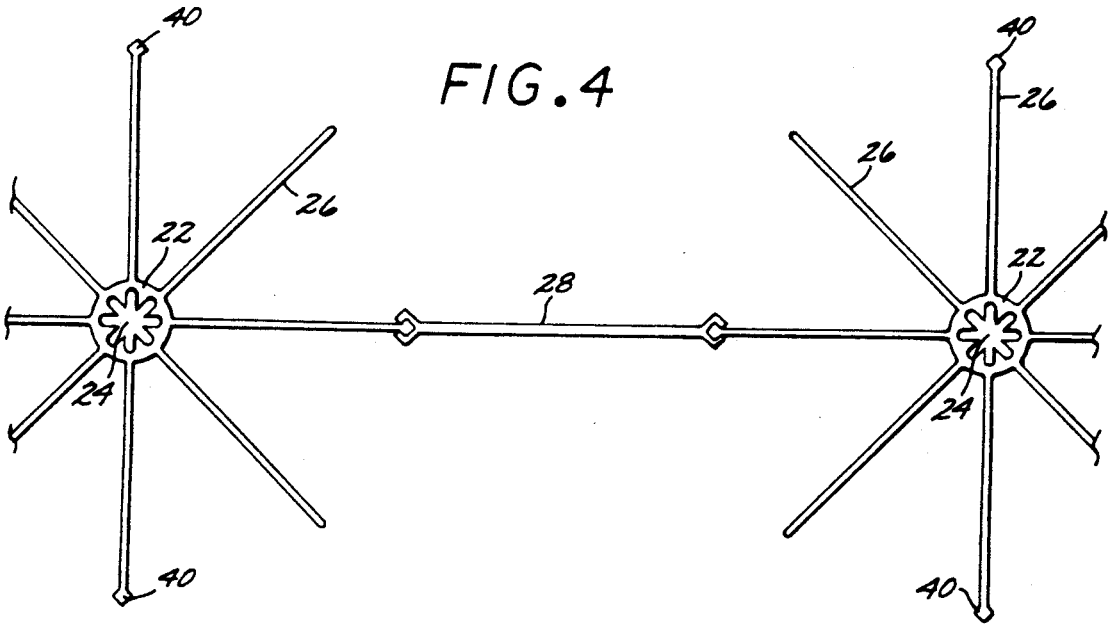
FIG. 4 is a top view showing the interconnection and fastening of two heat exchange elements with the first preferred embodiment of the bracket.

FIG. 3 illustrates a first preferred embodiment of a bracket 28 in accordance with the present invention, comprising a substantially flat panel 30 which in the herein described preferred embodiment 20 may have a thickness within the range of about 3/16 to 3/8 of an inch, a length within the range of about 1 to 15 inches, and a depth within the range of about 1 to 20 inches. The bracket 28 includes holes or apertures 32 through which the assembled brackets 28 and heat exchange elements 20 are mounted to an external frame 34 with nuts 36 and bolts 38, as is shown schematically on FIG. 8.

A principal novel feature of the present invention concerns the manner in which the brackets 28 are fastened to the heat exchange elements 20 to form an overall assembly, such as the one schematically shown on FIG. 9. The elongated edges of a number of the fins 26 of the heat exchange element 20 include a rail 40 which has a substantially diamond shaped cross section.

As is shown on the drawing figures, in the herein described preferred embodiment 20, the rails 40 are included on four fins 26 spaced at approximately 90° from another. The diamond shaped rails 40 include four substantially flat surfaces 42.

Referring now primarily to FIG. 3, two parallel edges of the bracket 28 of the present invention form channels 44, and each channel 44 is configured to be complementary to and slidingly receive the rail 40 of the heat exchange elements 20. When the channel 44 of the bracket 28 receives the rail 40 of the heat exchange element 20 (in other words when the bracket 28 is mounted to the heat exchange elements 20) then the substantially flat inner surfaces 46 of the channels 44 engage the respective mating surfaces 42 of the rails 40, and thereby substantially prevent rotation of the brackets 28 and heat exchange elements 20 relative to one another.

FIGS. 5, 6 and 7 further illustrate the mounting of the brackets 28 to the heat exchange elements 20. Thus, in accordance with the present invention the brackets 28 are placed into the desired positions on the rails 40 of two heat exchange elements 20 which are to be mechanically joined together. The configuration of the rails 40 and channels 44 already prevent rotation of these members relative to one another. To prevent further sliding of the brackets 28 on the rails 40 and to complete the assembly of the atmospheric vaporizer/heat exchanger from the herein described components of the present invention, the assembled rails 40 and channels 44 are deformed in several positions by the use of a crimping tool (not shown). The areas where the assembled rails 40 and channels 44 are deformed or crimped are shown on FIG. 5, and the deformed or crimped portions 47 of the assembly are shown in cross-section on FIGS. 6 and 7. Preferably, as is illustrated on FIG. 5, in accordance with the present invention, each rail-to-channel assembly is crimped at three places.

FIG. 9 illustrates schematically the mounting of eight heat exchange elements 20 to one another with the brackets 28, in accordance with the present invention. It is a significant advantage of the present invention that the above-described mounting of the heat exchange elements to one another does not require the use of self-tapping screws (not shown), nor any other type screws (not shown) and thereby eliminates labor, potential for corrosion and the salts hazard associated with sharp screws (not shown) which in the prior art atmospheric evaporators/heat exchanger protrude on one side of the respective fins or brackets.

Referring now to FIG. 8, mounting of the bracket 28 to an angle iron 48 with bolts 38 and nuts 36 is shown. The angle iron 48, in turn, is mounted to the external frame 34. In this regard it will be readily appreciated by those skilled in the art, that in order to form a functional atmospheric vaporizer/heat exchanger several heat exchange elements 20 of the invention may be connected to one another in the above-described manner with a plurality of brackets 28 of the invention, and that the assembly is ultimately supported by the external frame 34 which is schematically illustrated on FIG. 8. In the assembly the heat exchange elements 20 are preferably disposed with the tubes 22 being substantially vertical, whereby the flow of the cryogenic fluid (not shown), into and out of the tubes in a serial or parallel fashion, is accomplished by suitable tubes, conduits and/or manifolds (not shown) which are known in the art and do not form part of the present invention.

FIG. 10 illustrates a second preferred embodiment of the bracket 50 of the present invention. As can be seen on the drawing figure, the bracket 50 has a tubular frame 52 of substantially rectangular cross-section. A plate 54 extends from each of the four corners 56 of the frame 52, substantially in the directions of the diagonals of the rectangular frame 52. The edge of each plate forms a channel 44 of substantially the same description as the channel 44 described in connection with the first preferred embodiment of the bracket 28. Thus, the channel 44 of the second preferred embodiment of the bracket 50 is attached to the rails 40 of the fins 26 of the heat exchange elements 20 in substantially the same way as the channels 44 of the first preferred embodiment 28. Because the second preferred embodiment of the bracket 50 has four plates 54 with channels 44, it can be mounted to four heat exchange elements 20, as is shown schematically on FIG. 12. The brackets 50 are particularly well suited for joining the heat exchange elements forming the corners of an atmospheric vaporizer. With such an arrangement the vaporizer may be supported above the ground or other surface by securing one end of the rectangular shaped legs within the openings of the brackets 50 and anchoring the other ends of the legs to suitable footings imbedded in the ground.

FIG. 11 illustrates a third preferred embodiment of the bracket 58 in accordance with the present invention. The bracket 58 includes a base plate 60 and two side plates 62 integrally constructed with the base plate 60. Edges of the side plates 62 carry the channels 44, which, like the channels 44 of the previously described embodiments of the brackets are adapted for slidingly engaging the rails 40 of the heat exchange elements 20. FIG. 12 illustrates how the third preferred embodiment of the bracket 58 is utilized to interconnect two heat exchange elements 20. It should be apparent from the foregoing, the three above-described embodiments of the brackets provide for a large degree of versatility and variations in the assembly heat exchange elements to one another.

Both the heat exchange elements 20 and the preferred embodiments of the brackets of the present invention are readily manufactured from aluminum by an extrusion process which, by itself, is well known in the art. As it should be apparent from the foregoing description, the advantages of the invention include ease of manufacture, ease of assembly, elimination of the need for spacers as in the prior art, and the lack of screws in the assembled structure. Several modifications of the present invention may become readily apparent to those skilled in the art in light of the foregoing disclosure. For example, different bracket designs from those illustrated with channels 44 on the edges of some or all of the external fins may be utilized to connect the finned tubes together or to connect the tubes to a base or frame. The scope of the present invention is to be interpreted solely from the following claims in light of the disclosure.

What is claimed is:

1. A heat exchanger assembly for vaporizing a cryogenic fluid, the heat exchanger assembly comprising a plurality of heat exchanger elements and a plurality of brackets mounting the heat exchanger elements to one another to form a mechanically rigid structure:

each heat exchanger element comprising an elongated tube which forms an internal conduit wherein the cryogenic fluid flows, and a plurality of fins disposed radiating outwardly from the elongated tube, at least two of said fins including along their respective edges, which is remote from and substantially parallel with the tube, first means for slidably engaging complementary second means disposed along an edge of the bracket and for securing the bracket and heat exchange element in a fixed position; and each bracket comprising a member having at least two linear edges, the linear edges including the second means for slidably engaging the first means of the heat exchange element, one of the first and second means comprising a rail having a thickness greater than the thickness of the fin or bracket member adjacent the rail, the rail being bounded by a plurality of substantially flat outer surfaces, the other of said first and second means comprising a channel with an elongated opening therein which is smaller than the thickness of the rail and configured to slidingly engage the rail, the channel having substantially flat inner surfaces complementary to the outer rail surfaces for substantially preventing relative rotation between the heat exchange element and the bracket, the channel having a deformed portion that protrudes into the rail laterally of the edges to prevent sliding movement between the heat exchanger element and the bracket in a direction parallel to the edges of the fin and bracket and for mechanically locking the heat exchanger element and bracket together.

2. The combination of heat exchanger tube and bracket of claim 1 wherein the heat exchanger tube is made of extruded aluminum and the bracket is made of extruded aluminum.

3. The combination of heat exchanger tube and bracket of claim 2 wherein the heat exchanger tube has at least four fins which are disposed at 90° relative to one another, and wherein each of the four fins include the first means on their respective edges.

4. The combination of heat exchanger tube and bracket of claim 2:

wherein the fins of the heat exchanger tube which have the first means comprise panels and wherein the first means comprises the rail along the entire edge of said fin formed integrally with the fin; and wherein the second means of the bracket comprises the channel along the entire edge of the bracket formed integrally with the bracket.

5. The combination of heat exchanger tube and bracket of claim 4 wherein the rail has a substantially diamond shaped cross section.

6. The combination of heat exchanger tube and bracket of claim 5 wherein the channel has four substantially flat internal surfaces which are complementary to and mate with the respective surfaces of the rail having the substantially diamond shaped cross section.

7. The combination of claim 1 wherein the bracket is a substantially flat plane.

8. The combination of claim 1 wherein the bracket comprises a tubular frame and four plates extending from the frame, the channels being formed at the respective edges of the four plates.

9. The combination of claim 1 wherein the bracket comprises a base plate and two side plates disposed at obtuse angles to the base plate, the channels being formed at respective edges of the side plates.

10. The heat exchanger assembly of claim 1 wherein the heat exchanger element has at least four fins which are disposed at 90° relative to one another, and wherein each of the four fins include the first means on their respective edges.

11. The heat exchanger assembly of claim 10 wherein the fins of the heat exchanger element comprise substantially flat panels and wherein the first means comprises the rail, the rail extending along substantially the entire edge of the fin; and wherein the second means comprises the channel, the channel extending along substantially the entire edge of the bracket.

12. The combination of claim 11 wherein the rail has a substantially diamond shaped cross section.

13. The combination of claim 12 wherein the channel has four substantially flat internal surfaces which are complementary to and mate with the respective surfaces of the rail having the substantially diamond shaped cross section.

14. The heat exchanger assembly of claim 10 comprising at least one heat exchanger element which is assembled with the brackets to four other heat exchanger elements.

15. The invention of claim 1 wherein the channel has a plurality of deformed portions.

16. In combination, at least one aluminum heat exchanger element and at least one aluminum bracket for use in an assembly of heat exchanger elements and brackets for vaporizing a cryogenic fluid:

the heat exchanger element comprising an elongated tube which forms an internal conduit wherein the cryogenic fluid flows, and at least four fins, each of the four fins being a substantially flat panel disposed radially outwardly from the outer circumference of the tube at substantially right angles to one another, each of the four fins having a linear edge and a rail formed along the edge, the rail being bounded by a plurality of flat surfaces; and the bracket comprising a member having a tubular fame and four plates extending from the frame terminating in linear edges, a channel being formed on each of the four linear edges, the channel configured to slidingly engage the rail and having complementary internal mating flat surface to the rail, whereby when the bracket and heat exchanger element are assembled rotation of the element and of the bracket relative to one another is substantially prevented.

17. The combination of claim 16 wherein the heat exchanger element and the bracket both comprise extruded aluminum.

18. The combination of claim 17 wherein the rail of the heat exchanger element has a substantially diamond shaped cross section.

19. The combination of claim 18 wherein the channel has four substantially flat internal surfaces which are complementary to and mate with the respective surfaces of the rail having the substantially diamond shaped cross section.

20. The combination of claim 16 wherein the rail of the heat exchanger element has a substantially diamond shaped cross section.

21. The combination of claim 20 wherein the channel has a plurality of deformed portions which protrude into the rail laterally of the edges to prevent sliding movement between the edges of the heat exchanger element and the bracket in a direction parallel to the edge of the fin and bracket and for mechanically locking the heat exchanger element and bracket together.

22. In combination, at least one aluminum heat exchanger element and at least one aluminum bracket for use in an assembly of heat exchanger elements and brackets for vaporizing a cryogenic fluid:

the heat exchanger element comprising an elongated tube which forms an internal conduit wherein the cryogenic fluid flows, and at least four fins, each of the four fins being a substantially flat panel disposed radially outwardly from the outer circumference of the tube at substantially right angles to one another, each of the four fins having a linear edge and a rail formed along the edge, the rail being bounded by a plurality of flat surfaces; and the bracket comprising a member having a base plate and two side plates disposed at obtuse angles to the base plate, the side plates terminating in linear edges, a channel being formed on each of the two linear edges, the channel configured to slidingly engage the rail and having a complementary internal mating flat surface to the rail, whereby when the bracket and heat exchanger element are assembled rotation of the element and of the bracket relative to one another is substantially prevented.

23. The combination of claim 22 wherein the rail of the heat exchanger element has a substantially diamond shaped cross section.

24. The combination of claim 23 wherein the channel has a plurality of deformed portions which protrude into the rail laterally of the edges to prevent sliding movement between the edges of the heat exchanger element and the bracket in a direction parallel to the edge of the fin and bracket and for mechanically locking the heat exchanger element and bracket together.

* * * * *